US008617384B2

(12) United States Patent
Haizmann et al.

(10) Patent No.: US 8,617,384 B2
(45) **Date of Patent: *Dec. 31, 2013**

(54) INTEGRATED CATALYTIC CRACKING GASOLINE AND LIGHT CYCLE OIL HYDROPROCESSING TO MAXIMIZE P-XYLENE PRODUCTION

(75) Inventors: Robert Haizmann, Rolling Meadows, IL (US); Laura E. Leonard, Western Springs, IL (US)

(73) Assignee: UOP LLC, Des Plaines, IL (US)

( * ) Notice: Subject to any disclaimer, the term of this patent is extended or adjusted under 35 U.S.C. 154(b) by 153 days.

This patent is subject to a terminal disclaimer.

(21) Appl. No.: 13/269,075

(22) Filed: Oct. 7, 2011

(65) Prior Publication Data

US 2013/0087484 A1 Apr. 11, 2013

(51) Int. Cl.
*C10G 55/06* (2006.01)
*C10G 55/08* (2006.01)

(52) U.S. Cl.
USPC ..... 208/69; 208/49; 208/60; 585/319; 585/805

(58) Field of Classification Search
USPC ..... 585/319, 805; 208/49, 60, 69
See application file for complete search history.

(56) References Cited

U.S. PATENT DOCUMENTS

| | | | |
|---|---|---|---|
| 4,417,973 | A | 11/1983 | Angevine et al. |
| 4,606,816 | A | 8/1986 | Harandi |
| 4,789,457 | A | 12/1988 | Fischer et al. |
| 5,271,851 | A | 12/1993 | Nelson et al. |
| 5,310,477 | A | 5/1994 | Lomas |
| 5,837,130 | A | 11/1998 | Crossland |
| 5,944,982 | A | 8/1999 | Lomas |
| 6,113,776 | A | 9/2000 | Upson |
| 6,900,365 | B2 | 5/2005 | Chen et al. |
| 2010/0230324 | A1 | 9/2010 | Al-Alloush et al. |
| 2010/0243527 | A1 | 9/2010 | Lomas et al. |
| 2010/0331589 | A1 | 12/2010 | Zimmermann et al. |

OTHER PUBLICATIONS

Laird, D., Fractionation impact on FCC gasoline and LCO sulfur content, NPRA Annual Meeting Papers, v 2002, 16p, 2002; Conference: 2002 Annual Meeting—National Petrochemical and Refiners Association, Mar. 17, 2002-Mar. 19, 2002.

De Rezende Pinho, A.; Gilbert, W.R.; Montaury Pimenta, R.D. . Influence of feed hydrotreatment on FCC product aromatics, 2004 AIChE Spring Meeting, Conference Proceedings, 2004; ISBN-10: 0816909423; Conference: 2004 AIChE Spring Meeting, Conference Proceedings, Apr. 25, 2004-Apr. 29, 2004; Sponsor: American Institute of Chemical Engineers, AIChE.

*Primary Examiner* — Thuan D Dang
(74) *Attorney, Agent, or Firm* — Mark R Willis

(57) ABSTRACT

A process for maximizing p-xylene production begins by producing a naphtha fraction and a light cycle oil fraction from a fluid catalytic cracking zone. The gasoline and light cycle oil fractions are combined and hydrotreated to produce a hydrotreated product. Fractionation of the hydrotreated product in a fractionation zone makes a light ends cut, a naphtha cut, a hydrocracker feed and an unconverted oil fraction. The hydrocracker feed is sent to a hydrocracking zone to make a hydrocracker product, which is then recycled back to the fractionation zone, feeding the hydrocracker product above an outlet for the hydrocracker feed, but below an outlet for the naphtha cut. The naphtha cut goes to a dehydrogenation zone where hydrogen is removed to make aromatics from naphthenes to make a dehydrogenated naphtha. The dehydrogenated naphtha is fed to an aromatics recovery unit to recover p-xylene and other aromatics.

9 Claims, 1 Drawing Sheet

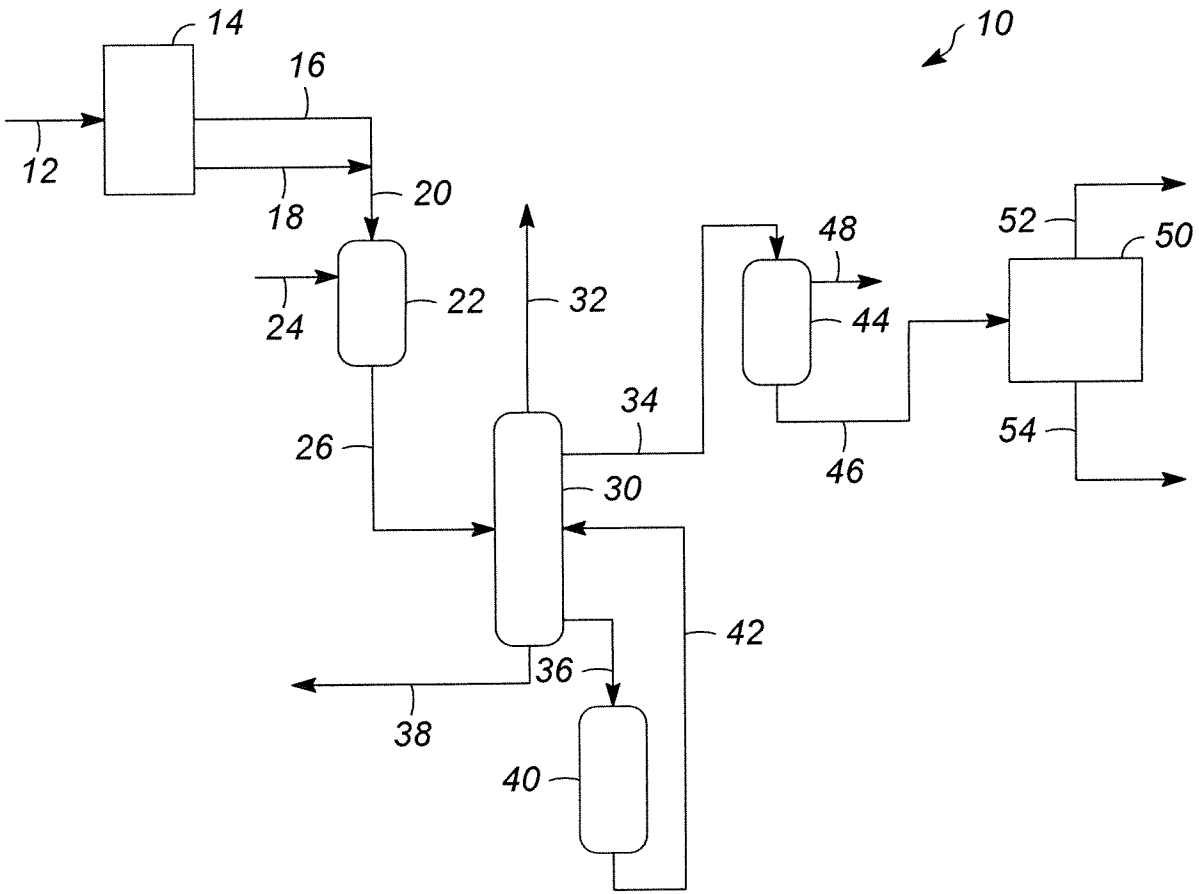
10
12
14
16
18
20
22
24
26
30
32
34
36
38
40
42
44
46
48
50
52
54

INTEGRATED CATALYTIC CRACKING GASOLINE AND LIGHT CYCLE OIL HYDROPROCESSING TO MAXIMIZE P-XYLENE PRODUCTION

CROSS REFERENCE TO RELATED APPLICATIONS

This application is related to U.S. Ser. Nos. 13/268,883, and 13/269,096, each filed concurrently herewith and herein incorporated by reference.

BACKGROUND OF THE INVENTION

Refineries include a large number of processing steps to make a wide variety of hydrocarbon products. These facilities are very versatile, enabling them to vary the product slate to accommodate changes in season, technologies, consumer demands and profitability. Hydrocarbon processes are varied yearly to meet seasonal needs for gasoline in the summer months and heating oils in the winter months. Availability of new polymers and other new products from hydrocarbons causes shifts in product distributions. Needs for these and other petroleum-based products results in continuously changing product distribution from among the many products generated by the petroleum industry. Thus, the industry is constantly seeking process configurations that produce more of the products that are higher in demand at the expense of less profitable goods.

Most new aromatics complexes are designed to maximize the yields of benzene and para-xylene ("p-xylene"). Benzene is a versatile petrochemical building block used in many different products based on its derivation including ethylbenzene, cumene, and cyclohexane. Para-xylene is also an important building block, which is used almost exclusively for the production of polyester fibers, resins, and films formed via terephthalic acid or dimethyl terephthalate intermediates. Thus, the demand for plastics and polymer goods has created a need in the refining industry for generation of large amounts of aromatics, including benzene, xylenes, particularly p-xylene, and other feedstocks for an aromatics plant.

SUMMARY OF THE INVENTION

A process for maximizing p-xylene production begins by producing a naphtha fraction and a light cycle oil fraction from a fluid catalytic cracking zone. The gasoline and light cycle oil fractions are combined and hydrotreated to produce a hydrotreated product. Fractionation of the hydrotreated product in a fractionation zone makes a light ends cut, a naphtha cut, a hydrocracker feed and an unconverted oil fraction. The hydrocracker feed is sent to a hydrocracking zone to make a hydrocracker product, which is then recycled back to the fractionation zone, feeding the hydrocracker product above an outlet for the hydrocracker feed, but below an outlet for the naphtha cut. The naphtha cut goes to a dehydrogenation zone where hydrogen is removed to make aromatics from naphthenes to make a dehydrogenated naphtha. The dehydrogenated naphtha is fed to an aromatics recovery unit to recover p-xylene and other aromatics.

One surprising aspect of this process is that selectivity to make naphtha increases as the conversion in the hydrocracking unit decreases. The recycle of the hydrocracker products through the fractionation zone and back to the hydrocracking unit allows the hydrocracking unit to run at low conversion per pass, thereby increasing the overall selectivity for products in the boiling range of about 93° C. (200° F.) to about 177° C. (350° F.).

It was also discovered that selectivity to aromatics also increases as conversion in the hydrocracking unit decreases. As discussed above, recycle of the products from the hydrocracking zone is used to generate high yields of aromatics. Even at low conversion per pass the improved selectivity and large number of passes generate sufficient aromatics as feedstock for an aromatics recovery unit.

DETAILED DESCRIPTION OF THE DRAWING

The FIGURE is a flow diagram showing an embodiment of the integrated process of the present invention.

DETAILED DESCRIPTION OF THE INVENTION

An integrated process, generally 10, is provided to convert a hydrocarbonaceous feedstock 12 containing high boiling range hydrocarbons into a diesel range boiling hydrocarbons into products that include a large amount of p-xylene. Generally, the hydrocarbonaceous feedstock includes high boiling range hydrocarbons that boil in a range greater than a light cycle oil ("LCO"). A preferred feedstock is a vacuum gas oil ("VGO"), which is typically recovered from crude oil by vacuum distillation. A VGO hydrocarbon stream generally has a boiling range between about 315° C. (600° F.) and about 565° C. (1050° F.). An alternative feedstock 12 is residual oil, which is a heavier stream from the vacuum distillation, generally having a boiling range above 499° C. (930° F.).

The selected feedstock is introduced into a fluid catalytic cracking zone 14 and contacted with a catalyst composed of finely divided particulate catalyst. The reaction of the feedstock in the presence of catalyst is accomplished in the absence of added hydrogen or the net consumption of hydrogen. As the cracking reaction proceeds, substantial amounts of coke are deposited on the catalyst. The catalyst is regenerated at high temperatures by burning coke from the catalyst in a regeneration zone. Carbon-containing catalyst, referred to herein as "coked catalyst," is continually transported from the reaction zone to the regeneration zone to be regenerated and replaced by carbon-free regenerated catalyst from the regeneration zones. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones and combusting coke in the regenerator are well known by those skilled in the art of fluidized catalytic cracking ("FCC") processes.

The FCC catalyst (not shown) is optionally a catalyst containing, medium or smaller pore zeolite catalyst exemplified by ZSM-5, ZSM-11, ZSM-12, ZSM-23, ZSM-35, ZSM-38, ZSM-48, and other similar materials. U.S. Pat. No. 3,702,886 describes ZSM-5. Other suitable medium or smaller pore zeolites include ferrierite, erionite, and ST-5, developed by Petroleos de Venezuela, S. A. The second catalyst component preferably disperses the medium or smaller pore zeolite on a matrix comprising a binder material such as silica or alumina and an inert filer material such as kaolin. The second component may also comprise some other active material such as Beta zeolite. These catalyst compositions have a crystalline zeolite content of 10 to 25 wt-% or more and a matrix material content of 75 to 90 wt-% or less. Catalysts containing 25 wt-% crystalline zeolite materials are preferred. Catalysts with greater crystalline zeolite content may be used, provided they have satisfactory attrition resistance. Medium and smaller pore zeolites are characterized by having an effective pore opening diameter of less than or equal to 0.7 nm, rings of 10 or fewer members and a Pore Size Index of less than 31. The residence time for the feed in contact with the catalyst in a riser is less than or equal to 2 seconds. The exact residence time depends upon the feedstock quality, the specific catalyst and the desired product distribution. The shorter residence time assures that the desired products, such as light olefins, do not convert to undesirable products. Hence, the diameter and height of the riser may be varied to obtain the desired residence time.

Products of the FCC include light ends, a naphtha fraction 16 and a light cycle oil fraction 18. The naphtha fraction 16 and the light cycle oil fraction 18 are combined into a single stream 20 and fed to a hydrotreating zone 22. For the purposes of this patent application, "hydrotreating" refers to a processing zone 22 where a hydrogen-containing treat gas 24 is used in the presence of suitable catalysts that are primarily active for the removal of heteroatoms, such as sulfur and nitrogen. The hydrotreating zone 22 may contain a single or multiple reactors (preferably trickle-bed reactors) and each reactor may contain one or more reaction zones with the same or different catalysts.

The hydrotreating zone 22 operates to reduce the levels of sulfur and other contaminates in the combined gasoline and light cycle oil fraction 20 to produce a hydrotreated product 26 at the appropriate quality levels to be used as feedstock to a catalytic reformer (not shown). The combined gasoline and light cycle oil feedstock 20 and hydrogen treat gas 24 are contacted with a suitable catalyst at hydrotreating conditions to reduce the level of contaminates in the hydrocarbonaceous stream to generally meet desired levels of sulfur, nitrogen and hydrogenation. For example, the hydrotreating reaction zone 22 may produce a hydrotreated product 26 having a reduced concentration of sulfur of about 20 to less than 1 ppm by weight, or, in some embodiments, less than 1 ppm by weight and/or a reduced concentration of nitrogen of about less than 30 ppm by weight, more preferably from about 0.2 to about 1 ppm by weight. The exact contaminate reduction depends on a variety of factors such as the quality of the feedstock, the hydrotreating conditions, the available hydrogen, and the hydrotreating catalyst, among others.

The hydrotreating zone 22 in one aspect operates at relatively mild conditions generally not over about 454° C. (850° F.) and 17.3 MPa (2500 psig) in order to reduce overtreating the higher boiling hydrocarbons. At severe conditions, a high degree of cracking occurs, often cracking the desired products, such as naphtha, to less valuable light ends. In general, the hydrotreating reaction zone 22 operates at a temperature from about 315° C. (600° F.) to about 426° C. (800° F.), a pressure from about 3.5 MPa (500 psig) to about 17.3 MPa (2500 psig), and a liquid hourly space velocity from about 0.1 $hr^{-1}$ to about 10 $hr^{-1}$.

Suitable hydrotreating catalysts for use herein are any known conventional hydrotreating catalyst and include those that are comprised of at least one Group VIII metal (preferably iron, cobalt and nickel, and more preferably cobalt and/or nickel) and at least one Group VI metal (preferably molybdenum and/or tungsten) on a high surface area support material, preferably alumina. Other suitable hydrotreating catalysts include zeolitic catalysts, as well as noble metal catalysts where the noble metal is selected from palladium and platinum. It is within the scope herein that more than one type of hydrotreating catalyst can be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Of course, the particular catalyst compositions and operating conditions may vary depending on the particular hydrocarbons being treated, the concentration of heteroatoms and other parameters.

The effluent from the hydrotreating zone 26 is introduced into a fractionation zone 30. In one embodiment, the fractionation zone 30 is a hot, high pressure stripper to produce a first vapor stream 32 including hydrogen, hydrogen sulfide, ammonia and $C_2$ through $C_4$ gaseous products. This vapor stream 32 is often referred to as the light ends cut. A naphtha cut 34, including $C_{10}$-aromatic hydrocarbons is removed in an intermediate cut. A heavy hydrocarbon stream 36 of the unconverted fuel oil is fed to a hydrocracking zone 40. A stream of unconverted diesel and heavier range material 38 is optionally removed from the fractionators. The hydrocracking zone 40 is preferably operated at a temperature from about 149° C. (300° F.) to about 288° (550° F.) and a pressure from about 3.5 MPa (500 psig) to about 17.3 MPa (2500 psig). In another embodiment (not shown), the fractionation zone 30 is operated at a lower pressure, such as atmospheric pressure, and operating without specific hydrogen stripping.

In one aspect, the hydrocracking zone 40 may contain one or more beds of the same or different catalysts. In one such aspect, the preferred hydrocracking catalysts utilize amorphous bases or low-level zeolite bases combined with one or more Group VIII or Group VIB metal hydrogenation components. In another aspect, the hydrocracking zone 40 contains a catalyst which comprises, in general, any crystalline zeolite cracking base upon which is deposited a minor proportion of a Group VIII metal hydrogenating component. Additional hydrogenation components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms.

It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. An example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 to Rabo et al., which is hereby incorporated by reference in its entirety.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least about 20 percent, metal-cation-deficient, based on the initial ion-exchange capacity. A specifically desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, including iron, cobalt, nickel, ruthenium, rhodium, palladium, osmium, iridium and platinum. In addition to these metals, other promoters may also be employed in conjunction therewith, including the metals of Group VIB, such as molybdenum and tungsten. The amount of hydrogenating metal in the catalyst can vary within wide ranges. Broadly speaking, the catalyst includes any amount of metal between about 0.05 percent and about 30 percent by weight. In the case of the noble metals, it is normally preferred to use about 0.05 to about 2 weight percent.

In some embodiments, a method for incorporating the hydrogenating metal is to contact the zeolite base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like, if desired, and calcined in air at temperatures of, e.g., about 371° to about 648° C. (about 700° to about 1200° F.) to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718, which is hereby incorporated by reference in its entirety.

In one aspect of the process, the feedstock 36 for the hydrocracking zone 40 is exposed to hydrogen and is contacted with the hydrocracking catalyst at hydrocracking conditions to achieve conversion levels between about 40% and about 85 percent. At low conversion, selectivity for naphtha production, as well as selectivity for aromatics content in the naphtha, are both improved. A secondary goal is to maintain sufficiently low sulfur and nitrogen contaminants in the naphtha cut 34 to feed a reforming unit without additional hydrotreating. The hydrocracker product 42 also includes some diesel range material, preferably low and most preferably ultra low sulfur diesel (i.e., less than about 10 ppm by weight sulfur) with an improved cetane number (i.e., about 40 to about 55).

Other conversion levels also may be used depending on the content of the feedstock 36 to the hydrocracking zone 40, flowrates through the hydrocracking zone 40, the catalyst systems, hydrocracking conditions, and the desired product qualities, among other considerations. In one aspect, the operating conditions to achieve such conversion levels include a temperature range from about 90° C. (195° F.) to about 454° C. (850° F.), a pressure range from about 3.5 MPa (500 psig) to about 17.3 MPa (2500 psig), a liquid hourly space velocity ("LHSV") from about 0.1 to about 10 $hr^{-1}$, and a hydrogen circulation rate from about 84 normal $m^3/m^3$ (500 standard cubic feet per barrel) to about 4200 $m^3/m^3$ (25,000 standard cubic feet per barrel). In some embodiments, the temperature ranges from about 371° C. (700° F.) to about 426° C. (800° F.). The hydrocracking conditions are variable and are selected on the basis of the feedstock 36 composition, desired aromatics content and the nature and composition of the naphtha cut 34 used to provide feedstock to the dehydrogenation zone 44.

Products from the hydrocracking zone 40 are recycled to the fractionation zone 30, feeding the hydrocracker product 42 above an outlet for the hydrocracker feed 36, but below an outlet for the naphtha cut 34. Light ends 32 and the naphtha cut 34 produced in the hydrocracking zone 40 are separated in the fractionation zone 30 and drawn off with their respective streams. Unreacted cycle oil is driven toward the bottom of the fractionation zone 30 where it is drawn off with gas oil newly received from the FCU in the hydrocracker feed stream 36 to return to the hydrocracking zone 40. In this manner, the light gas oil is recycled to extinction.

The naphtha cut 34 from the fractionation zone 30 is sent to a dehydrogenation zone 44 to make a dehydrogenated naphtha 46. Dehydrogenation occurs in the first stage or first section of a catalytic reformer. Hydrogen is removed from the hydrocarbon compounds to make olefinic and aromatic compounds. Naphthenes, such as cyclohexane, are converted to aromatics including benzene, toluene and xylene.

Catalytic reforming conditions and catalysts are utilized in the dehydrogenation zone 44. In the dehydrogenation unit 44, the naphtha cut 34 is contacted with a catalytic reforming catalyst under catalytic reforming conditions. The dehydrogenation catalyst typically includes a first component platinum-group metal, a second component modifier metal, and a third component inorganic-oxide support, which is typically high purity alumina. Typically, the platinum-group metal is in the range of about 0.01 to about 2.0 wt-% and the modifier metal component is in the range of about 0.01 to about 5 wt-%, each based on the weight of the finished catalyst. The platinum-group metal is selected from platinum, palladium, rhodium, ruthenium, osmium, and iridium. The preferred platinum-group metal component is platinum. The metal modifiers may include rhenium, tin, germanium, lead, cobalt, nickel, indium, gallium, zinc, uranium, dysprosium, thallium, and mixtures thereof. One example of a dehydrogenation catalyst for use in the present invention is disclosed in U.S. Pat. No. 5,665,223, the teachings of which are incorporated herein by reference. Typical dehydrogenation conditions include a liquid hourly space velocity from about 1.0 to about 5.0 $hr^{-1}$, a ratio of hydrogen to hydrocarbon from about 1 to about 10 moles of hydrogen per mole of hydrocarbon feed 34 entering the dehydrogenation zone 44, and a pressure from about 2.5 to about 35 $kg/cm^2$. Hydrogen 48 produced in the dehydrogenation zone 44 exits the unit.

The dehydrogenated naphtha 46 is then fed to an aromatics recovery unit 50 to recover p-xylene 52 and other aromatic products 54. Any known steps in aromatics recovery are used to recover p-xylene 52. The configuration of these steps varies with the feedstock quality and the desired product slate. A number of process steps that may be used in aromatics recovery include, but are not limited to, olefin saturation; separating aromatic-containing streams into a benzene-rich stream and a stream of toluene and heavier hydrocarbons; extracting benzene from the benzene-enriched stream; separating the toluene and heavier hydrocarbon enriched stream to produce a toluene-enriched stream and a xylenes-plus-enriched stream; transalkylating the toluene-enriched stream; separating one or more xylene-enriched stream(s) in a xylene fractionation zone to produce a xylene stream; and passing the xylene stream to a para-xylene separation zone.

Any method or apparatus for recovering aromatics is useful. While not intended to be limiting, examples of possible methods of aromatics extraction are described below. One embodiment of an aromatics recovery unit 50 is taught in U.S. Pat. No. 7,304,193, herein incorporated by reference in its entirety. In another embodiment, the aromatics recovery unit 50 includes solvent extraction of the dehydrogenated naphtha 46 to separate the aromatics-rich solvent from the non-aromatic hydrocarbons using a solvent comprising sulfolane and water. Also known as tetramethylene sulfone or 2,3,4,5 tetrahydrothiophene-1,1-dioxide, sulfolane is highly soluble in both aqueous solvents and hydrocarbons. The four carbon ring provides stability in hydrocarbon solvents, while the two oxygen atoms bonded to the sulfur atom are highly polar, allowing for its solubility in water. After extracting the aromatic compounds from the non-aromatic compounds in the dehydrogenated naphtha 46, the sulfolane is economically recovered from the aromatics by extraction with water. Examples of this process are taught in U.S. Pat. Nos. 3,361,664 and 4,353,794, each of which is herein incorporated by reference.

This process is useful to improve both the quantity and quality of naphtha produced as feedstock for an aromatics unit. In tests, decreasing the conversion in the hydrocracking unit from 80% to 60% resulted in an increase of 55% to 60% in the selectivity to naphtha. The same decrease in conversion altered the selectivity to aromatics in the naphtha from 30% to 38%. Recycle of the unconverted hydrocracker feedstock resulted in an overall conversion of 98%. These tests demonstrate the usefulness and the unique characteristics of this process.

While particular embodiments of the process have been shown and described, it will be appreciated by those skilled in the art that changes and modifications may be made thereto without departing from the invention in its broader aspects and as set forth in the following claims.

What is claimed is:

1. A process for maximizing p-xylene production comprising the steps of:

producing a naphtha fraction and a light cycle oil fraction from a fluid catalytic cracking zone;

combining the naphtha and the light cycle oil fractions;

hydrotreating the combined naphtha and light cycle oil fractions to produce a hydrotreated product;

fractionating the hydrotreated product in a fractionation zone to make a light ends cut, a naphtha cut, a hydrocracker feed and an unconverted oil fraction;

sending the hydrocracker feed to a hydrocracking zone to make a hydrocracker product;

recycling the hydrocracker product to the fractionation zone, feeding the hydrocracker product above an outlet for the hydrocracker feed, but below an outlet for the naphtha cut;

sending the naphtha cut to a dehydrogenation zone to make a dehydrogenated naphtha; and feeding the dehydrogenated naphtha to an aromatics recovery unit to recover p-xylene and other aromatics.

2. The process of claim 1 wherein the aromatics recovery unit utilizes an extraction with sulfolane.

3. The process of claim 1 wherein the hydrotreating step further comprises operating at a temperature of about 315° C. (600° F.) to about 426° C. (800° F.) and pressures of about 3.5 MPa-13.8 MPa (500 psig-2000 psig).

4. The process of claim 1 wherein the hydrotreating step further comprises utilizing a catalyst comprising molybdenum.

5. The process of claim 1 wherein the hydrotreating step further comprises utilizing a catalyst comprising at least one of cobalt, nickel and combinations thereof.

6. The process of claim 1 wherein the hydrotreating step further comprises selecting a weight hourly space velocity to produce the naphtha cut having a sulfur content of less than 1 ppm by weight.

7. The process of claim 1 wherein the hydrotreating step further comprises selecting a weight hourly space velocity such that the hydrocracker feed has a nitrogen content of less than 30 ppm by weight.

8. The process of claim 1 wherein the hydrocracking zone is operated at a temperature of about 371° C. (700° F.) to about 426° C. (800° F.) and at a pressure from about 3.5 MPa (500 psig) to about 17.3 MPa (2500 psig).

9. The process of claim 1 wherein a feedstock to the fluid catalytic cracking zone is a vacuum gas oil.

* * * * *